US007070677B2

(12) United States Patent
Henricson

(10) Patent No.: US 7,070,677 B2
(45) Date of Patent: Jul. 4, 2006

(54) METHOD AND APPARATUS FOR TREATING PULP WITH FILLER

(75) Inventor: Kaj Henricson, Helsinki (FI)

(73) Assignee: Andritz OY, Helsinki (FI)

( * ) Notice: Subject to any disclaimer, the term of this patent is extended or adjusted under 35 U.S.C. 154(b) by 199 days.

(21) Appl. No.: 10/415,921

(22) PCT Filed: Nov. 14, 2001

(86) PCT No.: PCT/FI01/00986

§ 371 (c)(1),
(2), (4) Date: May 5, 2003

(87) PCT Pub. No.: WO02/40773

PCT Pub. Date: May 23, 2002

(65) Prior Publication Data

US 2004/0050508 A1 Mar. 18, 2004

(30) Foreign Application Priority Data

Nov. 16, 2000 (FI) ..... 20002513

(51) Int. Cl.
*D21H 17/70* (2006.01)
*D21H 17/67* (2006.01)

(52) U.S. Cl. ..... 162/63; 162/9; 162/58; 162/181.4; 162/185

(58) Field of Classification Search ..... 162/9, 162/19, 57, 63, 181.4, 237, 244, 58, 90, 181.1, 162/183, 185; 422/209, 210, 224, 225, 228, 422/229, 232, 233; 423/430, 432
See application file for complete search history.

(56) References Cited

U.S. PATENT DOCUMENTS

| | | | | |
|---|---|---|---|---|
| 3,678,598 | A * | 7/1972 | Quiles | 34/128 |
| 3,780,447 | A * | 12/1973 | Fales | 34/136 |
| 3,966,542 | A * | 6/1976 | Oldshue | 162/57 |
| 4,298,426 | A * | 11/1981 | Torregrossa et al. | 162/57 |
| 4,560,527 | A * | 12/1985 | Harke et al. | 264/500 |
| H980 | H * | 11/1991 | Harrison | 425/222 |
| 5,087,326 | A * | 2/1992 | Jones | 162/244 |
| 5,482,458 | A * | 1/1996 | Kyffin | 432/14 |
| 5,665,205 | A | 9/1997 | Srivatsa et al. | |
| 5,679,220 | A | 10/1997 | Matthew et al. | |
| 6,355,138 | B1 * | 3/2002 | Doelle | 162/9 |
| 6,387,212 | B1 * | 5/2002 | Christian | 162/9 |

(Continued)

FOREIGN PATENT DOCUMENTS

EP 0 791 685 8/1997

OTHER PUBLICATIONS

Perry's Chemical Engineers' Handbook (7th Edition), pp. 12-25 to 12-26, 12-52 to 12-54, 12-64 to 12-65 (1997).*

*Primary Examiner*—Eric Hug
*Assistant Examiner*—Steve Alvo
(74) *Attorney, Agent, or Firm*—Nixon & Vanderhye, P.C.

(57) ABSTRACT

The present invention relates to a method of and apparatus for treating pulp with filler. The method and apparatus according to the invention are especially well suitable for treating pulp with filler, the mixing of which to the pulp requires simultaneous treatment of the pulp with gas. The treatment of cellulose pulp suspension of the paper making industry and calcium hydroxide with carbon dioxide is presented as one preferred embodiment of the invention.

12 Claims, 2 Drawing Sheets

Figure 1A:
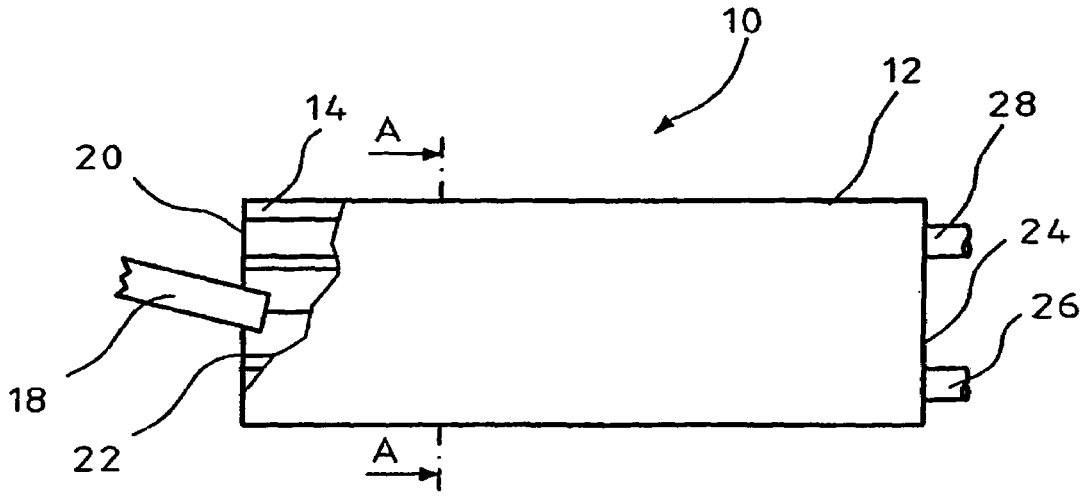

U.S. PATENT DOCUMENTS 6,458,241 B1 * 10/2002 Doelle et al. ..... 162/9
6,471,825 B1 * 10/2002 Doelle et al. ..... 162/9
6,673,211 B1 * 1/2004 Doelle ..... 162/261
6,706,148 B1 * 3/2004 Joisson et al. ..... 162/181.6

* cited by examiner

METHOD AND APPARATUS FOR TREATING PULP WITH FILLER

This application is the US national phase of international application PCT/FI01/00986 filed 14 Nov. 2001 which designated the U.S.

The present invention relates to a method of and apparatus for treating pulp with filler. The method and apparatus according to the invention are especially well suitable for treating pulp with filler, the mixing of which to the pulp requires simultaneous treatment of the pulp with gas. The treatment of cellulose pulp suspension of the paper making industry and calcium hydroxide with carbon dioxide is presented as one preferred embodiment of the invention.

Fillers are added to pulps, i.e. cellulose fiber suspensions in paper production for improving the properties of paper or for saving cellulose-based raw material. One commonly used filler is calcium carbonate $CaCo_3$. The present invention is a method of forming calcium carbonate on the fibers of the pulp by precipitating and/or crystallizing utilizing the reaction:

$$Ca(OH)_2+CO_2 \Delta CaCO_3+H_2O$$

In other words, calcium carbonate is made of calcium hydroxide and carbon dioxide. When mixing together pulp, calcium hydroxide and carbon dioxide, a calcium carbonate fiber compound is formed that may efficiently be used in paper production. This process has been explained in detail in Finnish patent publication FI-B-100670.

Thus, FI-patent publication 100670, which thoroughly describes the treatment with filler of a pulp based on cellulose fibers, may be considered to be the starting point for the present invention. The expression <<pulp based on cellulose fibers>> in this context refers to pulps used in paper and pulp industry, which pulps are chemically or mechanically produced of plants or their parts containing lignocellulose, such as wood or grass fibers, and delignified or having the lignine present either partially or completely, such as cellulose, mechanical pulp, refined mechanical pulp, mixtures thereof, fines and/or derivatives originating therefrom. The term <<paper >>, in turn, is used to refer to various grades of paper and board, coated or non-coated, produced by means of a paper and board machine.

In practice, the purchasers of paper, partly guided by legislative actions, more and more dictate the development direction of paper products. The purchasers of printing paper want to save in mailing costs and reduce the amount of generated waste. Waste penalties depending on the weight are imposed to packings. A common trend is that the price of paper products is increased by such additional cost encumbrances as energy and environmental protection taxes. Due to said reasons, the purchasers of paper want to have paper products with a decreased grammage, still fulfilling high quality demands.

Thus the attempt is to produce high quality paper using a smaller amount of raw material than earlier. When the grammage of the paper is decreased, the density of the paper becomes a critical property. In many applications, a property still more critical is the stiffness of the paper, which decreases greatly as the density increases. Therefore the aim is to change the structure of paper so that the density is as low as possible. This sets further demands for raw materials and paper making processes.

Keeping paper-based communication competitive in relation to electrical communications requires further improving of the print quality of paper products. Considering the vigorous attempt to decrease the grammage of paper, gradual and slow development of paper grades is not enough in this situation, but more vigorous development of paper quality is needed in paper quality management.

The filling pores and cavities in cellulose fibers have been studied for years. According to the studies, the advantages include e.g. better filler retention in paper making, the possibility of increasing the filler-content of paper, decreased fouling and wearing of the wire, as well as decreased linting of paper. Scallan et al. have reported on the use of titanium dioxide in this connection. Patent publications U.S. Pat. Nos. 2,583,548 and 3,029,181 disclose methods in which calcium carbonate is precipitated inside the fibers and on the surfaces of the fibers using two salts easily dissolving in water, e.g. calcium chloride and sodium carbonate. A disadvantage of this method is the generation of soluble by-product, which has to be washed off prior to using the fiber in papermaking. This increases the water demand, due to which the method is not very realizable. A second disadvantage of said methods are chemical changes on the surface of the cellulose fiber, which result in a remarkable decrease in the strength of paper when using the fibers in paper production.

Publication JP 62-162098 describes a method, in which carbon dioxide is introduced into water suspension of cellulose and calcium hydroxide, whereby calcium carbonate is made to precipitate. A disadvantage of this method is that the treatment is carried out at a low consistency of the pulp. Thus, remarkable portion of the carbonate is precipitated in the bulk solution and on the surface of the fibers, and not inside the fibers, whereby the strength of the paper remains relatively low. Furthermore, when the pulp is at low consistency, the required water amount, as well as the volume of crystallizing reactors needed in an industrial scale turn to be very large, which is not economical. As also the pulp and paper industry aim at decreasing the amount of water used, the final target being a closed circulation, it is questionable whether said method can be carried out at a low consistency of pulp, considering said target.

U.S. Pat. No. 5,223,090, in turn, describes a method, in which the precipitation of calcium carbonate with carbon dioxide is effected in a pressurized disc refiner in a medium consistency cellulose suspension (consistency 5–15 weight percent). This method has provided better strength properties of paper than earlier filling methods. However, a significant disadvantage of this method is that the refiner blades wear out rapidly because calcium carbonate and its raw material, calcium hydroxide, have highly wearing properties. Furthermore, the method includes an additional low consistency stage prior to the precipitation of carbonate, in which the calcium hydroxide is mixed with pulp. Thus, the water amount needed is actually not smaller than in earlier methods, which restricts the applicability of the method to production scale.

The precipitation of calcium carbonate with carbon dioxide at a high consistency of pulp has been restricted by the fact that efficient mixing of cellulose fiber suspensions becomes more complicated and difficult when the consistency is above 2%. The reason for this is that in water cellulose fibers tend to form flocs, wherein the fibers are wrapped around each other. This phenomenon has been widely examined since the 1950's and it has been shown that flocculation is a mechanical phenomenon, always taking place when the fiber consistency exceeds the critical value. For cellulose fibers this limit consistency is very low, less than 0.1%.

The object of the invention described in FI patent 100670 mentioned in the above was to eliminate the disadvantages presented in the above. Especially the object of the invention was to provide a new method of introducing filler to pulp based on cellulose fiber so that the introduction might be effected in a medium consistency pulp suspension in a controlled way.

Further, an object of the invention was to introduce a new method of adding filler to pulp based on cellulose fiber in such a way that better retention of the filler would be achieved and that the fillers would not be washed away with water to such an extent as earlier. A still further object of the invention was to introduce a new method of adding filler to pulp based on cellulose fiber so that the resulting paper would have higher bending stiffness than when using commercial fillers. Furthermore, an object of the invention was to eliminate problems existing in process water treatment, which are caused fillers that are washed away from the process together with water. Especially the object of the invention was to introduce a method of adding fillers to pulp so that the method would facilitate the application of higher filler-content in paper than before, simultaneously maintaining good retention.

The starting point in said publication was that the filler is added to the cellulose fiber suspension when the pulp is in fluidized condition at medium consistency, calcium hydroxide is added to the pulp and it is precipitated to calcium carbonate with carbon dioxide.

However, the main problem is how to mix a very large gas amount to a relatively small pulp flow. As stated in FI patent FI-B-100670, it would be preferable, if the mixing could be effected at a high consistency of pulp, clearly higher than 1%. In said patent, the issue has been solved by pressurizing the gas and fluidizing the mixture of gas, pulp and liquid. This may of course be done, but said process involves at least two problems.

One problem is the energy consumption of pressurizing and mixing. A plant with a capacity of about 100 tons a day requires for these operations easily more than 200 kW of energy.

Another significant problem is the gas volume. The gas volume of the carbon dioxide required may be 0.1–0.5 $nm^3$/kg of cellulosic fiber. If the consistency of the pulp or pulp suspension (mixture of cellulosic fibers and water) is e.g. 4%, the relation of the volumes of gas and pulp suspension will be 4–20. By pressurizing the mixture to a pressure of 10 bar, the relation of the volumes will be 0.4–2. However, a relation below 0.3 is considered as technically applicable, when the mixing is effected in a fluidizing mixer. In other words, even pressurizing of the mixture does not attribute to reaching a technically good level, which naturally leads to decreased efficiency. Increasing the pressure over 10 bar, in turn, is of course possible, but usually the apparatus requirements are more complicated when the pressure exceeds 10 bar.

Further, when taking into consideration that when precipitating calcium hydroxide, the most preferable gas is flue gas, the carbon dioxide of which is utilized, the volume of gas increases even more. The normal carbon dioxide content of flue gas is about 20%. This leads to a volume ratio of gas and pulp suspension of 2–10 at a pressure of 10 bar. In practice, the mixing is technically impossible using the method described in patent FI-B-100670.

A characteristic feature of a preferred embodiment for treating pulp with filler according to the present invention is that the pulp and gas containing carbon dioxide are fed into a rotating drum at pulp consistency 2–20%, preferably 3–7%, at the feed end of the drum and that during the treatment, calcium carbonate in the amount of at least 20 weight percent, preferably more than 50 weight percent, even more than 100 weight percent from the dry weight of the pulp is precipitated and/or crystallized on the pulp. The carbon dioxide content of the gas is more than 10%, preferably 10–25% in case of flue gas and preferably more than 80% when technical carbon dioxide gas is used.

A characteristic feature of a further embodiment of the invention is that the gas flows countercurrently in relation to the pulp suspension in a rotating drum. Said countercurrent method is not very sensitive to gas volumes. The drum may be filled mainly with gas, while the pulp takes only a fraction of its volume. The operation is most preferable at approximately atmospheric pressure, typically in the range of 0.9–1.2 bar. Nevertheless, the rotating drum may be pressurized, if needed, up to 15 bar, if decreasing the gas volume is needed for some reason.

A characteristic feature of a second preferred embodiment of the invention is that calcium hydroxide is fed into the drum together with the pulp. Calcium hydroxide reacts with the carbon dioxide present in the gas, and calcium carbonate precipitates on the fibers.

A characteristic feature of a third preferred embodiment of the invention is that the drum is divided by means of intermediate walls into at least two parts, preferably into more than three parts. A lead-through, i.e. a passage is provided in the intermediate walls, wherefrom the pulp and the gas can pass to the subsequent part of the drum. The object of the intermediate walls is to prevent excess mixing of gas between various parts of the drum. Thus, clearly various gas compositions may be maintained in various parts of the drum.

A characteristic feature of a fourth preferred embodiment of the invention is that the relation of the length and the diameter of the drum is between 2 and 15, preferably between 4 and 8. With this kind of drum geometry it is possible to ensure that both the pulp and the gas flow through the drum in form of a plug flow.

A characteristic feature of a fifth preferred embodiment of the invention is that the diameter of the drum is between 1 and 4 meters, preferably between 1.5 and 2.5 meters. This kind of construction provides a suitable mixing efficiency when the pulp rotates in the drum.

A characteristic feature of a sixth preferred embodiment of the invention is that the average retention time of the pulp in the drum is typically between 3 and 30 minutes, preferably between 5 and 15 minutes.

Other characteristic features of the method and apparatus according to the invention are disclosed in the appended claims.

Figure 1B:
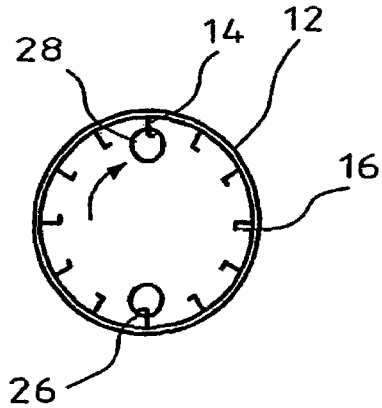
Figure 2:
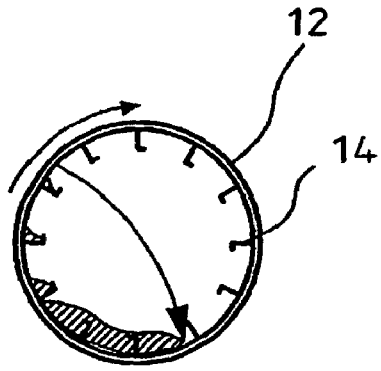
Figure 3:
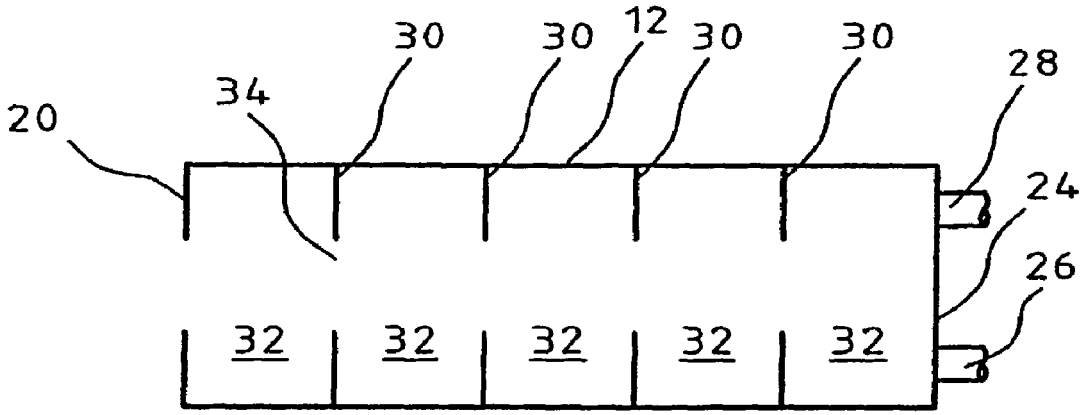

In the following, the method and apparatus according to the invention are explained in more detail with reference to the appended figures, of which FIG. 1*a* illustrates a treatment drum according to a preferred embodiment of the invention in side view, FIG. 1*b* illustrates in section A—A the treatment drum of FIG. 1, FIG. 2 illustrates the operation of the treatment drum of FIGS. 1*a* and 1*b*, and FIG. 3 illustrates a treatment drum according to a second preferred embodiment of the invention.

FIGS. 1*a* and 1*b* illustrate schematically a treatment drum according to a preferred embodiment of the invention. The drum comprises preferably a cylindrical shell 12, which may as well be conical or partly conical and partly cylindrical. One possible alternative construction may be a treatment drum having a polygonal cross section, whereby the drum might be formed of e.g. five or six rectangular or trapezoidal plate parts, said plate parts being connected at their long sides to form a treatment drum.

The drum 12 is not perforated and preferably its internal surface is provided with flat bars 14, which extend either totally from one end of the drum to another or at least to almost the whole length of the drum either directly in the axial direction of the drum or deviating therefrom to either direction. The orientation of the flat bars 14 may to some extent effect the retention time of the fiber suspension in the drum. However, the same effect may be obtained also by changing the banking of the drum 12. The height of the flat bars 14 is in the range of 10% of the diameter of the drum, preferably about 100–250 mm. On the other hand, the height of the flat bars 14 is effected also by the rotational speed of the drum 12, so that the height always has to be fitted to match the rotational speed.

According to a further embodiment of the invention, the flat bars 14 may be formed to resemble more a bucket, whereby their inner edge 16 is bent to the rotational direction of the drum. Said bent part 16 contributes to the retaining of the pulp on th flat bar.

FIG. 1*a* illustrates also a chute 18, via which the fiber suspension is fed into the treatment drum 12. The chute 18 leads the suspension into the drum either through a central opening 22 in an end plate 20 rotating together with the drum 12 or through an opening in a stationary non-rotating end plate sealed in relation to the drum. If needed, the chute may be replace with a conduit located stationary in either the rotating or the stationary end plate of the drum, which facilitates thorough collection of residual gases from the drum.

In the embodiment of the Figure, the other end of the drum 12 is provided with a stationary end wall 24 sealed in relation to the drum 12, said end wall being provided with a conduit 26 for treated fiber suspension being discharged from the drum and a conduit 28 for gas containing carbon dioxide to be introduced into the drum. The Figures do not illustrate devices used for rotating the drum, which devices are known per se. One method of arranging the drum rotatable is to fasten around the drum, on at least two locations on the length of the drum, a strong girth and rings positioned on rollers arranged on a machine frame so that the drum can rotate supported by the rollers. The actual drive motor may be arranged to operate together with a gear rack arranged in connection with one of the rings.

FIG. 2 illustrates the operation mode of the drum 12 according to the invention, in other words the movement of pulp during the rotation of the drum. The pulp passes to the internal surface of the drum 12 when feeding the pulp suspension through the chute 18 or the like conduit into the drum 12. As the drum 12 rotates, the pulp moves upwards supported by the flat bars 14. When the pulp reaches a predetermined level, depending on both the centrifugal force generated by the rotation of the drum 12 and the friction of the fiber suspension in relation to the flat bars 14, it falls down against the drum 12 due to gravity. The only restricting factor in view of the operation is that the centrifugal force generated by the rotational motion of the drum shall remain lower than the gravitational force. In other words, the drum 12 should not be rotated so fast that the fiber suspension could not fall down from the internal surface of the drum 12.

As the apparatus is in operation, the fiber suspension falls through the gas space of the drum 12 and impinges to the surface of the drum 12. When falling through the gas space and especially when impinging to the surface of the drum 12 and forming droplets there, the pulp is efficiently in contact with the gas space and the carbon dioxide therein. If it is desired to intensify the droplet formation of the fiber suspension, it is possible to arrange inside the drum 12 e.g. longitudinal bars, plates, flat bars or the like so that more collision surfaces are provided inside the drum.

When the drum 12 is kept slightly inclined in the longitudinal direction, or when flat bars 14 are inclined slightly towards the discharge end, the pulp is forwarded during each revolution of the drum 12 a short distance from the feed towards the discharge. Partly the feed of the pulp itself effects the same action, but only in a drum devoid of intermediate walls or other obstacles hindering the flow of the pulp from the feed end of the drum to the discharge end thereof.

FIG. 3 illustrates a sectional side view of a drum 14 according to a preferred embodiment of the invention. At least one intermediate wall 30 is arranged inside the drum 12, although it is preferable to arrange more than one intermediate wall 30 in the drum 12. The object of the intermediate walls is to prevent free mixing of gas inside the drum 12 and simultaneously form like multiple treatment zones or treatment chambers 32 inside the drum 12.

According to one alternative construction, the intermediate walls are provided with relatively small perforations, in the range of 10% of the cross sectional area of the drum 12. This way, the weaker gases may be kept apart from the stronger gases and thus obtain a higher efficiency.

According to another alternative construction, the intermediate walls 30 are provided with only one passage 34 in the middle, wherethrough the fiber suspension is transferred from one chamber of the drum 12 to another. For this purpose, lifting members or chutes are arranged in connection with each intermediate wall 30, via which members or chutes the fiber suspension can pass first to the lower edge of the passage 34 in the intermediate wall 30 and therethrough to another chamber 32 of the drum 12.

The apparatus illustrated in FIG. 3 operates so that fiber suspension together with calcium hydroxide is fed into the drum 12 via a chute 18 (illustrated in FIG. 1) located at one end of the apparatus. Gas containing carbon dioxide, which may be either industrially produced carbon dioxide or flue gas, is fed into the drum 12 via a conduit 28 located at the opposite end of the drum. As fresh treatment gas continuously flows from the conduit 28 into the drum 12, the gas already existing in the drum has a tendency to flow forward, whereby it passes via either perforations in the intermediate wall or the central passage 34 thereof to a next chamber 32 countercurrently in relation to the passing direction of the fiber suspension. At the same time, as the gas flows countercurrently, the carbon dioxide content of the gas decreases as the carbon dioxide reacts with calcium hydroxide present in the fiber suspension. In other words, this results in a situation that in the first treatment chamber, seen from the flow direction of the fiber suspension, the calcium hydroxide content of the fiber suspension is at its highest level and the carbon dioxide content of the gas in said chamber is at its lowest level. Nevertheless, due to the great amount of free calcium hydroxide, it can react with a small amount of carbon dioxide, whereby the carbon dioxide is efficiently utilized.

Just accordingly in the other end of the drum, in the vicinity of the discharge, as the amount of calcium hydroxide in the fiber suspension is small, the carbon dioxide content of the gas is high, whereby it is ensured that all calcium hydroxide is brought into contact with the carbon dioxide for precipitating the maximum amount of calcium carbonate.

After the treatment, the pulp discharging from the drum 12 via conduit 26 contains a remarkable amount of calcium carbonate, more than 10 weight percent, but preferably much more, even 10–15 times more. In comparison with the gas fed in, the gas leaves the drum 12 with a lower carbon dioxide content, the decrease corresponding to the amount of carbon dioxide combined to the pulp in form of carbonate.

EXAMPLE

About 100 tons of produced pulp is treated in the drum per day. A suitable length of the drum 12 is about 12 meters and a suitable diameter is about 2.2 meters. A suitable rotational speed of the drum 12 is 15 revolutions per minute and the retention time about 15 minutes. Thus, as the drum 12 rotates, the pulp will fall down about 230 times, during which time a good contact is established between the pulp, calcium hydroxide and the carbon dioxide in the pulp. Multiple falls ensure an almost continuous good mixing.

The pulp, i.e. fiber suspension, will be efficiently filled with the filler, i.e. calcium carbonate. A suitable amount of calcium carbonate may be about 100 weight percent of the weight of dry fiber. The amount of pulp to be fed is then about 50 tons per day.

The gas in the carbon dioxide may be almost 100 percent of technical carbon dioxide. However, the use of flue gas containing carbon dioxide, obtained e.g. from a lime kiln, is preferable. In that case the carbon dioxide content of the gas is about 10–25%, normally about 15–20%.

Advantages of the above-described method include e.g. low energy consumption and ability to utilize gases having a low carbon dioxide content. The energy requirement of the exemplary drum is about 50 kW, which has to be considered low compared to many fluidizing chemical mixers and their accessories. The drum solution does not require any accessories, such as gas compressors. An exhaust gas blower for forwarding the exhaust gases leaving the drum is the only accessory possibly needed.

In addition to the above described rotating drums, a stationary drum with an internal shaft provided with radial mixing arms may as well be utilized for bringing the calcium hydroxide present in the fiber suspension into contact with carbon dioxide. The pulp is mixed with the mixing arms so that the carbon dioxide in the gas space gets to intimate contact with the pulp particles and especially with the calcium hydroxide therein. The size of the drum used may be somewhat smaller than presented in the above, as the filling factor of the drum with pulp may be somewhat higher. Respectively, the rotational speed of the mixing shaft should be in the order of 10–30 rotations per minute, to ensure a sufficient mixing between the fiber suspension and the gas. The diameter of the drum used in this embodiment is in the order of 0.3–1.5 meters, preferably 0.5–1.0 meters, and the ration of length to diameter is 4–25, preferably 5–12. In other words, such a stationary drum would be somewhat longer and have a smaller diameter than a rotary drum. With respect to other parameters having an effect on the process, e.g. retention time, this embodiment corresponds to the solution described earlier. Thus, this stationary drum may also be divided into two or more chambers, if desired.

As noticed from the above, an economical and new type of method has been developed for bringing a fiber suspension containing calcium hydroxide into contact with carbon dioxide. It has to be noted from the above that the description of the invention only presents a few preferable embodiments of the invention with no intent of restricting the invention to cover only the mentioned constructions and methods. Thus, details presented in various figures may be freely used in connection with solutions described in connection with another figure or otherwise described in the description part, even though it may not have been specifically proposed in the above. Thus, based on the above it is clear that the appended claims alone determine the scope of the invention.

The invention claimed is:

1. A method of bringing a fiber suspension used in paper making into contact with a gaseous chemical in order to allow the gaseous chemical to react with a first chemical present in the fiber suspension or fed therein for generating a chemical to be used in paper making, the method comprising the steps of:

(a) feeding the fiber suspension and the first chemical into a treatment drum and causing the fiber suspension and the first chemical to pass through the treatment drum, (b) introducing the gaseous chemical into the drum via an opposite end of the drum with respect to the fiber suspension so that the gaseous chemical flows countercurrently in relation to the fiber suspension, and (c) mixing the fiber suspension in the drum to thereby bring the gaseous chemical into contact with the first chemical in the fiber suspension.

2. The method according to claim 1, wherein said mixing step (c) comprises rotating the drum.

3. The method according to claim 1, wherein said mixing step (c) comprises rotating a mixing device arranged inside the drum.

4. The method according to claim 1, wherein said first chemical is fed into the drum together with the fiber suspension.

5. The method according to claim 1, wherein the drum is divided into multiple treatment zones.

6. The method according to claim 1, wherein said mixing step (c) comprises rotating the drum at a speed of 10–20 revolutions per minute.

7. The method according to claim 1, wherein said mixing step (c) comprises mixing the fiber suspension in the drum for 3–30 minutes.

8. The method according to claim 1, wherein said mixing step (c) comprises mixing the fiber suspension in the drum for 5–15 minutes.

9. The method according to claim 1, wherein said gaseous chemical is carbon dioxide.

10. The method according to claim 1, wherein said gaseous chemical is flue gas containing carbon dioxide.

11. The method according to claim 1, wherein said first chemical is calcium hydroxide.

12. The method according to claim 1, wherein said feeding step (a) comprising feeding the fiber suspension into the drum at medium consistency.

* * * * *